United States Patent [19]

Itoh et al.

[11] Patent Number: 4,593,756

[45] Date of Patent: Jun. 10, 1986

[54] FIN-AND-TUBE TYPE HEAT EXCHANGER

[75] Inventors: Masaaki Itoh, Tsuchiura; Hiroshi Kogure, Mano; Kenji Iino; Izumi Ochiai, both of Tochigi; Yukio Kitayama; Masahiro Miyagi, both of Tochigi, all of Japan

[73] Assignee: Hitachi, Ltd., Tokyo, Japan

[21] Appl. No.: 746,680

[22] Filed: Jun. 20, 1985

[30] Foreign Application Priority Data

Jun. 20, 1984 [JP] Japan ..... 59-125113

[51] Int. Cl.[4] ..... F28F 1/32

[52] U.S. Cl. ..... 165/151

[58] Field of Search ..... 165/151, 152, 153

[56] References Cited

U.S. PATENT DOCUMENTS

| | | | |
|---|---|---|---|
| 2,246,258 | 6/1941 | Lehman | 165/151 X |
| 3,135,320 | 6/1964 | Forgó | 165/151 |
| 3,380,518 | 4/1968 | Canteloube et al. | 165/171 |
| 3,437,134 | 4/1969 | Oddy | 165/151 |
| 3,438,433 | 4/1969 | Gunter | 165/151 |

FOREIGN PATENT DOCUMENTS

| | | | |
|---|---|---|---|
| 472122 | 11/1914 | France | 165/151 |
| 25694 | 3/1981 | Japan | 165/151 |

*Primary Examiner*—Sheldon J. Richter

*Attorney, Agent, or Firm*—Antonelli, Terry & Wands

[57] ABSTRACT

A fin-and-tube type heat exchanger is disclosed in which the height of each raised, slotted louver from a fin base portion continuously changes in a direction crossing at right angles both the direction of the air flow and the direction of lamination of fins, and two or three kinds of such louver pairs, each consisting of louvers symmetric with each other with respect to the fin base portion, are arranged regularly.

2 Claims, 7 Drawing Figures

FIN-AND-TUBE TYPE HEAT EXCHANGER

BACKGROUND OF THE INVENTION

1. Field of the Invention

This invention relates generally to a fin-and-tube type heat exchanger. More particularly, the present invention relates to a fin-and-tube type heat exchanger having a worked fin surface which is suitably used for cross-fin type heat exchangers such as room air conditioners, package air conditioners, and for louver corrugate type heat exchangers such as can radiators, condensors, evaporators, and so forth.

2. Description of the Prior Art

An example of a fin-and-tube type heat exchanger is disclosed in U.S. Pat. Specification No. 3,438,433. The heat exchanger of this reference involves the problem that the temperature boundary layer of the upstream louver in the air flow overlaps the downstream louver, thereby reducing the heat transfer rate of the downstream louver.

Various attempts have been made to obviate this problem, and U.S. Pat. Specification No. 3,380,518 illustrates one of such attempts. In this prior art apparatus, the louvers are cut alternately on both sides of the fins and their height is changed so that the temperature boundary layer of the upstream louver does not adversely affect the downstream louver. However, the prior art involves another problem in that the gap between adjacent louvers is too small for the air to smoothly flow therethrough, so that the heat transfer rate is further reduced.

Furthermore, if the louvers are inclined with respect the air flow, or if an attack angle is provided, resistance of the air flow increases, thereby increasing pressure loss.

SUMMARY OF THE INVENTION

In order to eliminate the problems with the prior art described above, the present invention is directed to provide a fin-and-tube type heat exchanger having a high heat transfer rate by preventing the temperature boundary layer of the upstream fins from adversely affecting the downstream fins while restricting the increase in draft resistance.

In a fin-and-tube type heat exchanger which includes a large number of plate fins juxtaposed with one another with suitable gaps between them and a plurality of heat transfer tubes penetrating through the plate fins wherein a large number of raised, slotted portions are defined on the plate fins to disturb the air flow, a fin-and-tube type heat exchanger in accordance with the present invention is characterized in that the cut-up portions have four to six different kinds of corrugated shapes, or two to three different kinds of pairs of louvers, each pair being symmetric with respect to the base portion of the fin.

The term "corrugated shape" used herein means that the height from the fin substrate surface to the raised slotted portion changes continuously in the direction perpendicular to the air flow. Since four to six different kinds of corrugated shapes are provided in the present invention, the louvers on the downstream side are situated outside the temperature boundary layer of the upstream louvers; hence, a high heat transfer rate can be obtained. Moreover, since the corrugated louvers remain parallel to the air flow, the increase in draft resistance can be minimized.

DESCRIPTION OF THE PREFERRED EMBODIMENTS

Hereinafter, preferred embodiments of the invention will be described in detail with reference to the accompanying drawings.

Figure 1:
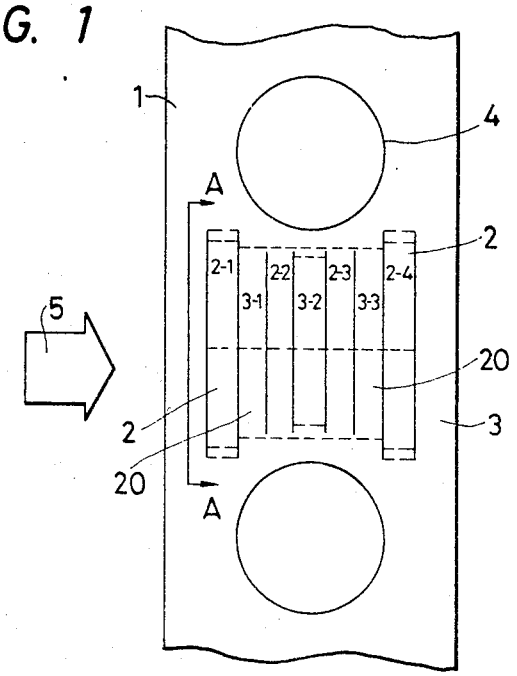
FIG. 1 is a plan view of a fin used in a fin-and-tube type heat exchanger in accordance with one embodiment of the present invention.

In FIG. 1, reference numeral 1 denotes a part of a plate fin (which will be referred to as a "fin"); 2 is a raised, slotted portion, 20 is another raised, slotted portion; and 3 is a substrate portion adjacent to the raised, slotted portion 2. The substrate portion 3 will be referred to as a "fin base portion". Different corrugations are formed on both the cut-up portion 2 and the separate cut-up portion 20 in the direction perpencicular to the air flow. Reference numeral 4 represents fitting holes into which a plurality of heat transfer tubes are inserted. Arrow 5 represents the direction of the air flow.

Basically, a fin-and-tube type heat exchanger consists of a large number of fins juxtaposed with one another with suitable gaps between them, and a plurality of heat transfer tubes penetrating through these fins. FIG. 1 specifically shows a part of only one fin.

As shown in FIG. 1, different corrugated shapes are formed on the raised, slotted portions 2 and 20. Therefore, the incoming air flow 5 generates a temperature boundary layer on the upstream louvers, but the downstream louvers are positioned away from the center of the temperature boundary layer. For this reason, a high heat transfer rate can be always maintained.

This will be explained in further detail.

Figure 2:
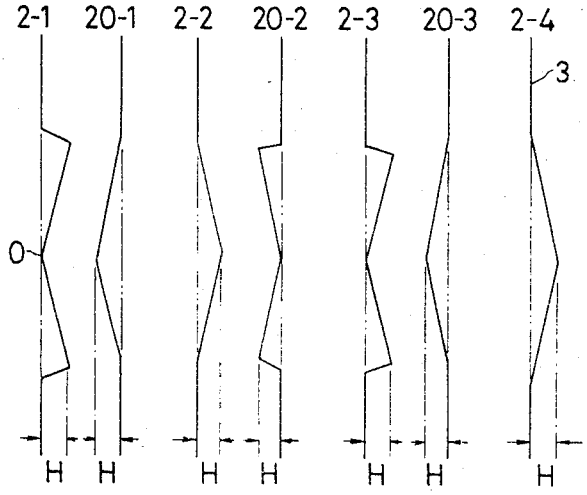
FIGS. 2 and 3 are sectional views taken along line A—A of FIG. 1, respectively.
Figure 3:
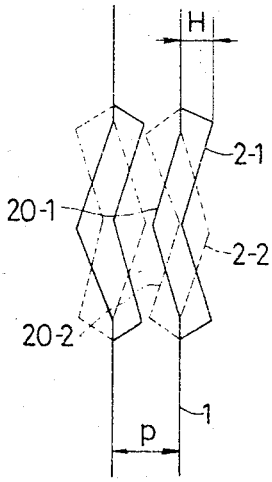

In FIG. 1, different reference numerals are on the raised, slotted portion 2 and the raised, slotted portion 20, and the corrugated louvers 2-1, 20-1, 2-2, 20-2, 2-3, 20-3 and 2-4 are shown arranged from the right to the left of the drawing. The bent portions of the corrugations are represented by broken lines in the drawing. FIGS. 2 and 3 are sectional views when taken along line A—A of FIG. 1. The corrugated louvers 2-1, 20-1, 2-2 and 20-2 have mutually different corrugated shapes, as represented by solid lines. The height H at the highest portion of all these louvers is equal, and the height of their bottom is equal to that of the fin base portion 3. The corrugated louvers 2-3, 20-3 and 2-4 have simular corrugated shapes to those of the corrugated louvers 2-1, 20-1 and 2-2, respectively. The corrugated louvers 2-1 and 20-2, and 2-2 and 20-1 are symmetrical with respect to the fin base portion 3. The symbol 0 represents the center of the louver in its longitudinal direction.

FIG. 3 is a sectional view of four corrugated louvers 2-1, 20-1, 2-2 and 20-2 when they are superposed from the direction of the air flow 5. In this drawing, the corrugated louvers 2-2 and 20-1 are represented by a solid line and 20-1 and 20-2, by a broken line for ease of illustration.

In FIG. 3, none of the corrugated shapes overlap. Therefore, exactly the same corrugated shape of a given raised, slotted portion appears only at the fourth raised, slotted portion with the three raised, slotted portions having different corrugated shapes being interposed between them. This arrangement will be compared with the conventional slit fins described earlier. In the prior art apparatus, the fin of a next raised, slotted portion lies at a same height of a given raised, slotted portion with the fin base portion being the center, and the adjacent raised, slotted portions are superposed on each other when viewed from the air flow.

In the embodiment of the present invention, at least two kinds of corrugated louvers 2-1 and 2-2 are formed on the raised, slotted portion 2 and at least two kinds of corrugated louvers 20-1 and 20-2 are formed on another raised, slotted portion 20. Thus, four corrugated shapes are formed. Therefore, the distance in which the adjacent corrugated shapes of the cut-up portions 2 and 20 come to be superposed when viewed from the direction of the air flow 5 can be increased by a factor of at least three.

This means that the downstream corrugated louvers lie outside the temperature boundary layer of the upstream corrugated louvers; hence, the heat transfer ratio can be improved. The more corrugated shapes, the greater the distance between two elements of the same corrugated shape. However, the effect does not increase beyond a certain distance.

A similar effect can be obtained by alternately disposing the corrugated shapes and flat sheets if the flat sheet is regarded as a kind of corrugation.

Figure 4:
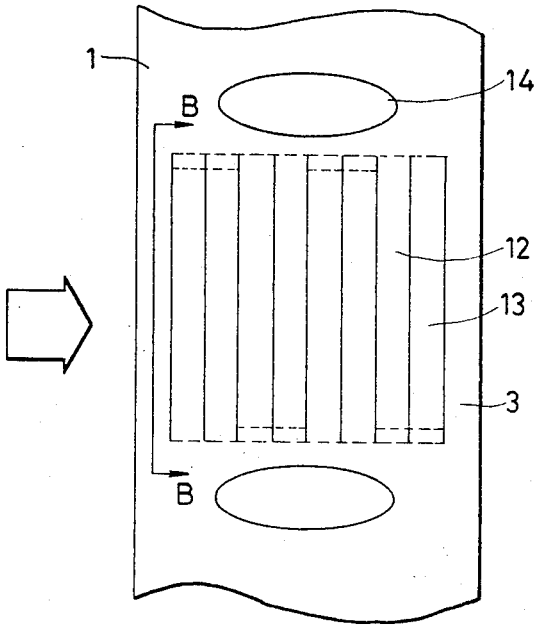
FIG. 4 is a plan view of a fin in another embodiment of the present invention.
Figure 5:
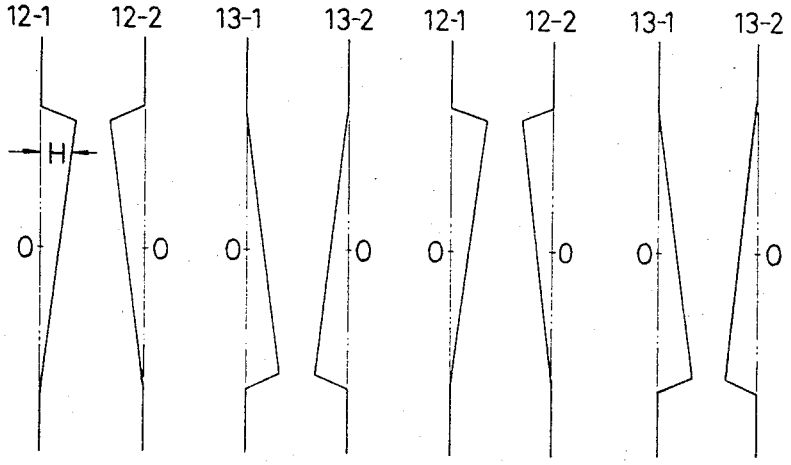
FIG. 5 and 6 sectional views taken along line B—B of FIG. 4 are respectively.

FIG. 4 shows another embodiment of the present invention, in which an elliptic tube or a flat tube is used as the heat transfer tube so as to drastically reduce the draft resistance.

Figure 6:
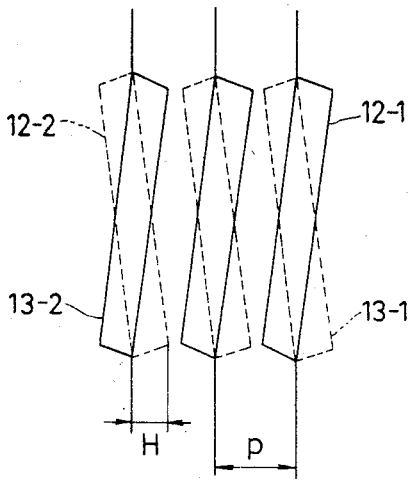

The shapes of the louvers 12 and 13 that are raised and slotted on the fin base portion 3, that is, the cut-up height H, is asymmetric with respect to the center 0 of the louvers in the longitudinal direction. Therefore, the water droplets that condense between the louvers are attracted by the surface tension to the portions close to the heat transfer tube having a small raised, slotted height H, thereby reducing the draft resistance. This effect becomes further remarkable when the fins are disposed horizontally, and the heat transfer tubes, vertically. As can be understood from FIG. 6, when four louvers are superposed with one another, they become symmetric as a whole with respect to the fin base portion, and the eccentric flow of the air can be prevented.

Figure 7:
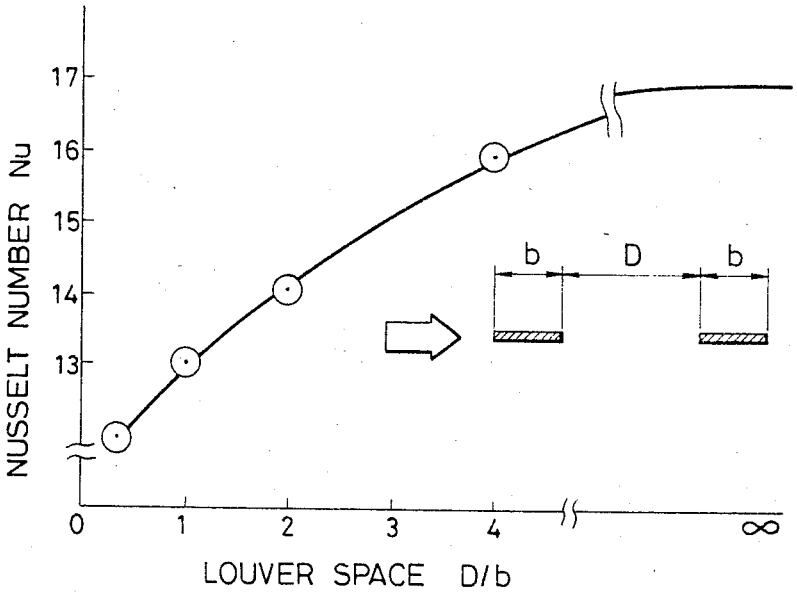
FIG. 7 shows change of Nusselt Number by louver space.

FIG. 7 shows the experimental result of the changes of the heat transfer rate $\alpha$ of the louver on the downstream side when the distance D between the louvers is changed. The Nusselt number Nu on the ordinate is defined by the following formula:

$$Nu = \alpha \cdot b / \lambda$$

where b is the louver width and $\lambda$ is the heat transfer rate of air. The Reynolds number Re in the experiment is 540. The Reynolds number is defined by the following formula:

$$Re = u \cdot b / \nu$$

where u is the velocity of air, and $\nu$ is the kinetic viscosity of air. The velocity of air when the louver width is 2 mm is calculated to be 4.2 m/s from Re=540.

It can be understood from FIG. 7 that when the distance D between the louvers is less than four times the louver width b, the heat transfer rate of the louver drops drastically. It can be also understood that the heat transfer rate can not be improved much even when the louver distance D is increased beyond four times the louver width b, but is equal to the heat transfer rate of a single louver.

Ideally, there should be five kinds of louvers. From the aspect of production technique, there should be four to six kinds of louvers, or two or three symmetrical pairs with respect to the fin base portion.

Although not shown in the drawings, the fins of the present invention can be also applied to louver corrugate fins used for car radiators, condensors, evaporators, and so forth. In such cases, the fins are mostly disposed horizontally so that the action of falling droplets of water is improved; hence, remarkable effects can be obtained in reducing the draft resistance and in preventing the scatter of water droplets.

What is claimed is:

1. In a fin-and-tube type heat exchanger of the type which includes a large number of plate fins laminated in parallel with one another with a predetermined pitch p between them, a plurality of heat transfer tubes penetrating through said fins, and a large number of louvers disposed on said plate fins in such a manner as to extend in the longitudinal direction crossing at right angles both the direction of the air flow and the direction of lamination of said plate fins, the improvement wherein the cut-up height H of each of said raised, slotted louvers from the surface of a fin substrate continuously changes throughout the longitudinal direction of said louver in such a fashion that the greatest value of said height H is $\frac{1}{2}$ of a fin pitch P and the smallest value is zero, four to six kinds of louvers having different change patterns are disposed, said louvers consist of two to three kinds of louver pairs whose cut-up height H is symmetrical with respect to said fin substrate surface, and said two to three kinds of louver pairs are disposed sequentially and repeatedly in the direction of the air flow.

2. The fin-and-tube type heat exchanger as defined in claim 1 wherein each of said louvers consists of a plane parallel to the direction of the air flow.

* * * * *